US007575072B2

(12) United States Patent
Reddoch, Sr.

(10) Patent No.: US 7,575,072 B2
(45) Date of Patent: Aug. 18, 2009

(54) METHOD AND APPARATUS FOR PROCESSING AND INJECTING DRILL CUTTINGS

(76) Inventor: Jeffrey A. Reddoch, Sr., 104 Ramblewood Dr., Lafayette, LA (US) 70508

( * ) Notice: Subject to any disclaimer, the term of this patent is extended or adjusted under 35 U.S.C. 154(b) by 291 days.

(21) Appl. No.: 11/286,476

(22) Filed: Nov. 26, 2005

(65) Prior Publication Data

US 2007/0119628 A1 May 31, 2007

(51) Int. Cl.
*E21B 21/06* (2006.01)

(52) U.S. Cl. ..... 175/207; 175/206; 175/217; 175/218

(58) Field of Classification Search ..... 175/206, 175/207, 217, 218; 366/263, 264; 222/385; 417/313, 900; 415/211.2, 212.1; 416/224; 210/173, 174
See application file for complete search history.

(56) References Cited

U.S. PATENT DOCUMENTS 3,698,832 A * 10/1972 Price ..... 415/148
4,942,929 A 7/1990 Malachosky et al.
5,109,933 A 5/1992 Jackson
5,303,786 A * 4/1994 Prestridge et al. ..... 175/66
5,405,223 A * 4/1995 Sirevag ..... 405/129.2
5,431,236 A 7/1995 Warren
6,321,860 B1 * 11/2001 Reddoch ..... 175/206
6,585,115 B1 * 7/2003 Reddoch et al. ..... 209/3
6,640,912 B2 11/2003 Reddoch

* cited by examiner

*Primary Examiner*—Jennifer H Gay
*Assistant Examiner*—Robert E Fuller
(74) *Attorney, Agent, or Firm*—Lemoine & Associates L.L.C.

(57) ABSTRACT

An improved cuttings system located adjacent a drilling rig's shale shaker system utilizing a vacuum collection/gravity fed processing system, thereby eliminating expensive and complicated cuttings transfer systems. The use of a vacuum cuttings collection system combined within a common fluid-filled open tank and submersible grinding pumps eliminate the need for extensive circulating and holding systems. Cuttings are sized and chemically prepared within the same tank and fed directly to an injection pump for discharge to cuttings transport tanks or injected down hole. Other improvements include non-restrictive cuttings sizing, filtering, and an injection pump cuttings relief system.

21 Claims, 7 Drawing Sheets

METHOD AND APPARATUS FOR PROCESSING AND INJECTING DRILL CUTTINGS

1. FIELD OF THE INVENTION

This invention relates generally to an improved processing system for preparing drill cuttings for injection into a well formation while drilling and more particularly to an improved process for sizing and processing the drill cuttings into a particulate matter for injection into cavities within the formation surrounding a well bore while drilling.

2. GENERAL BACKGROUND

When drilling for oil and gas, or other types of wells, a hole is bored into the earth, typically by a drill bit. Drilling mud containing various cuttings fluids are circulated in and out of the well, lubricating the drill bit and carrying away the rock shale, sand, and earth being removed from the bore. The material being removed from the bore is called drill cuttings. While the drilling fluid is necessary to the drilling operation, the shear nature of its formulation makes the mud a contaminant to the environment. Once the contaminated drill cuttings and drill fluid are circulated out of the well, the contaminated fluid and drill cuttings are circulated to a shaker system where the contaminant fluid and drill cuttings pass over a screen on the shakers and other fluid cleaning equipment where the drilling mud and fluids are substantially separated from the drill cuttings.

Drill cuttings contaminated with drilling mud and their various drilling fluids remain a contaminant to the environment and must be handled in an environmentally safe way. Therefore, several inventions have been developed to handle, transport, clean, dry, grind, and/or inject the contaminated drill cuttings and the residual drilling fluids adhering thereto back into the earth formation surrounding the well bore in an efficient and economical manner and in a way that does not restrict or choke the well's drilling production rate. Yet problems still persist that cause production delays due to an inability to process, transport, and dispose of the drill cuttings and economically recover and handle the residual drilling fluid contaminates. These problems are present in virtually all drilling operations.

Cuttings grinding and disposal systems as taught by the prior art have substantially improved the cuttings processing and disposal operations by injecting them back in the earth formation as the well is being drilled. Although vastly improved, such systems are complicated by numerous valves, manifolds, shakers, pumps, adjustable jets, etc., a plurality of tanks and circulatory systems, and further include separate injection skids that require supercharged pumps to expand the earth formations for injection. Although such systems performed the desired function of cuttings injection, several highly trained personnel are required to operate and maintain such systems. These systems have high operating costs, and use considerable deck space. Throughput for these cuttings injection systems have been improved over the years as a result of the addition of more and more sophisticated equipment added to the system to better prepare the cuttings for injection, such as the addition of secondary shakers, and grinding mills. Manifolds and adjustable jets were added to minimize the shutdown times for cleanout of oversize cuttings from the pump units. Improvements to manifolds and valves were made to correct pumps that wore out or plugged quickly.

In short, the cuttings processing and injection systems currently in use are a patchwork of makeshift add-ons used to solve immediate problems in the field.

The cuttings processing and injection system disclosed herein addresses the entire cuttings injection process as a whole and simplifies the process by eliminating choke points, thus improving throughput by improving flow paths, reducing equipment and over-all system size, reducing wear and thus lowering maintenance cost, reducing power consumption, and reducing manpower requirements while improving system reliability.

3. SUMMARY OF THE INVENTION

The disclosed invention is an improved drill cuttings processing system for well injection. The new and improved cuttings system is capable of being placed adjacent the drilling rig's shale shaker system and thus allowing use of gravity feed system and or a cuttings vacuum collection system, thereby eliminating expensive and complicated cuttings transfer systems. The use of an innovative vacuum cuttings collection system and the use of submersible in tank grinding pumps eliminate the need for extensive circulating and holding systems. Cuttings may be sized and chemically prepared within the same tank and fed directly to an injection pump or held in an adjacent make-up tank when necessary. Other embodiments disclose processes for non-restrictive cuttings sizing, filtering, and injection pump relief systems.

In operation the improved drill cuttings collection and processing system, including its injection pump system, utilizes a high velocity vacuum system for suctioning drill cuttings into an inverted hopper having its open end submerged in any open, fluidized container. The cuttings drop by gravity from the inverted hopper into the fluidized container where they are agitated and ground by submersible pumps located within the container into a fine particulate matter suitable for injection. The cuttings particulate within the fluidized container is selectively drawn into the inlet of an injection pump for discharge into a well bore.

It can be seen that open, fluidized containers allow easy access to the grinding pumps and visual inspection of the cuttings slurry. Further, the improved drill cuttings processing system reduces space requirements, utilizes onboard existing equipment whenever possible, reduces personnel, and reduces downtime and operating cost.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THE PREFERRED EMBODIMENT

Figure 1:
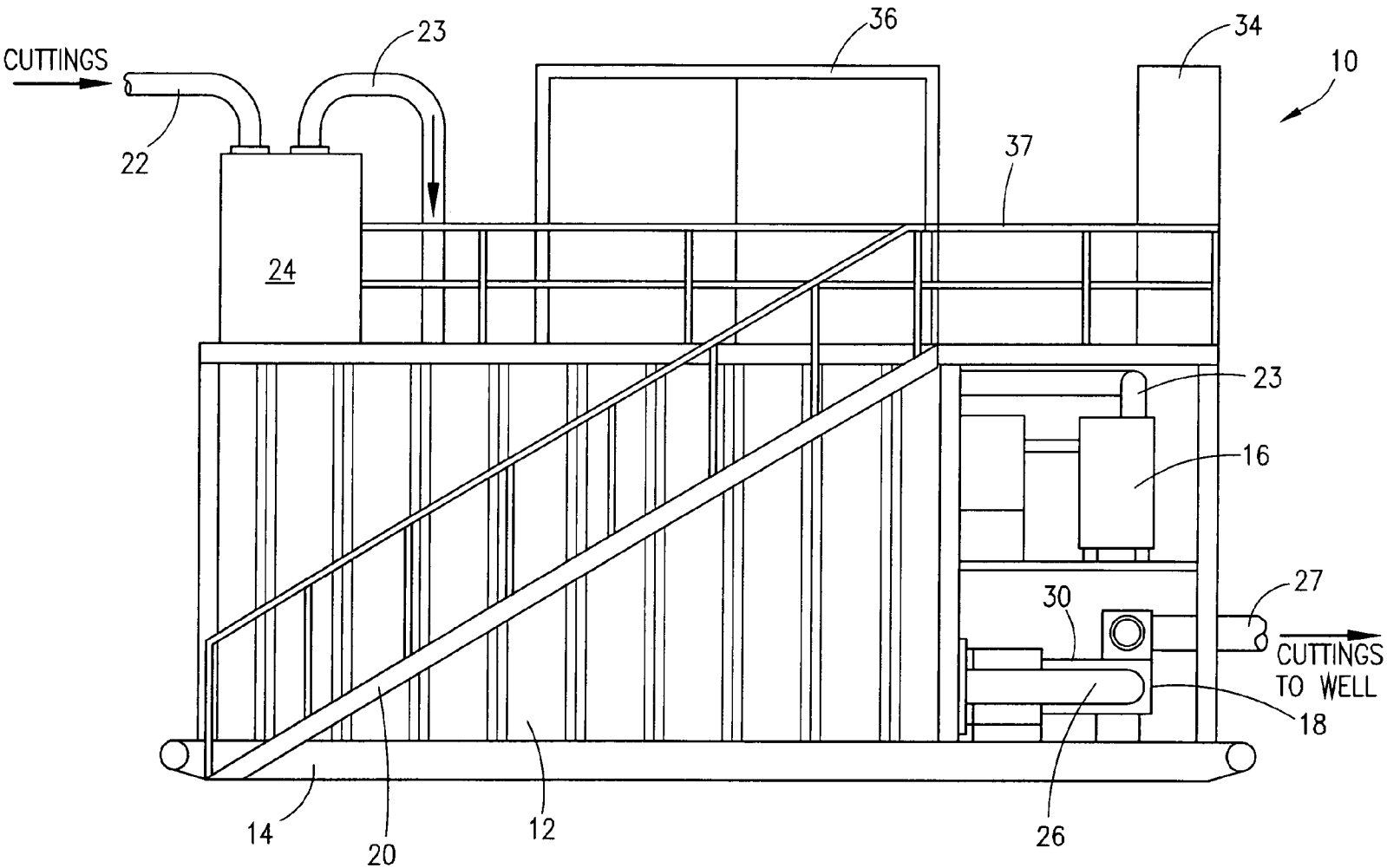
FIG. 1 is side elevation view of the improved cutting injection system.
Figure 2:
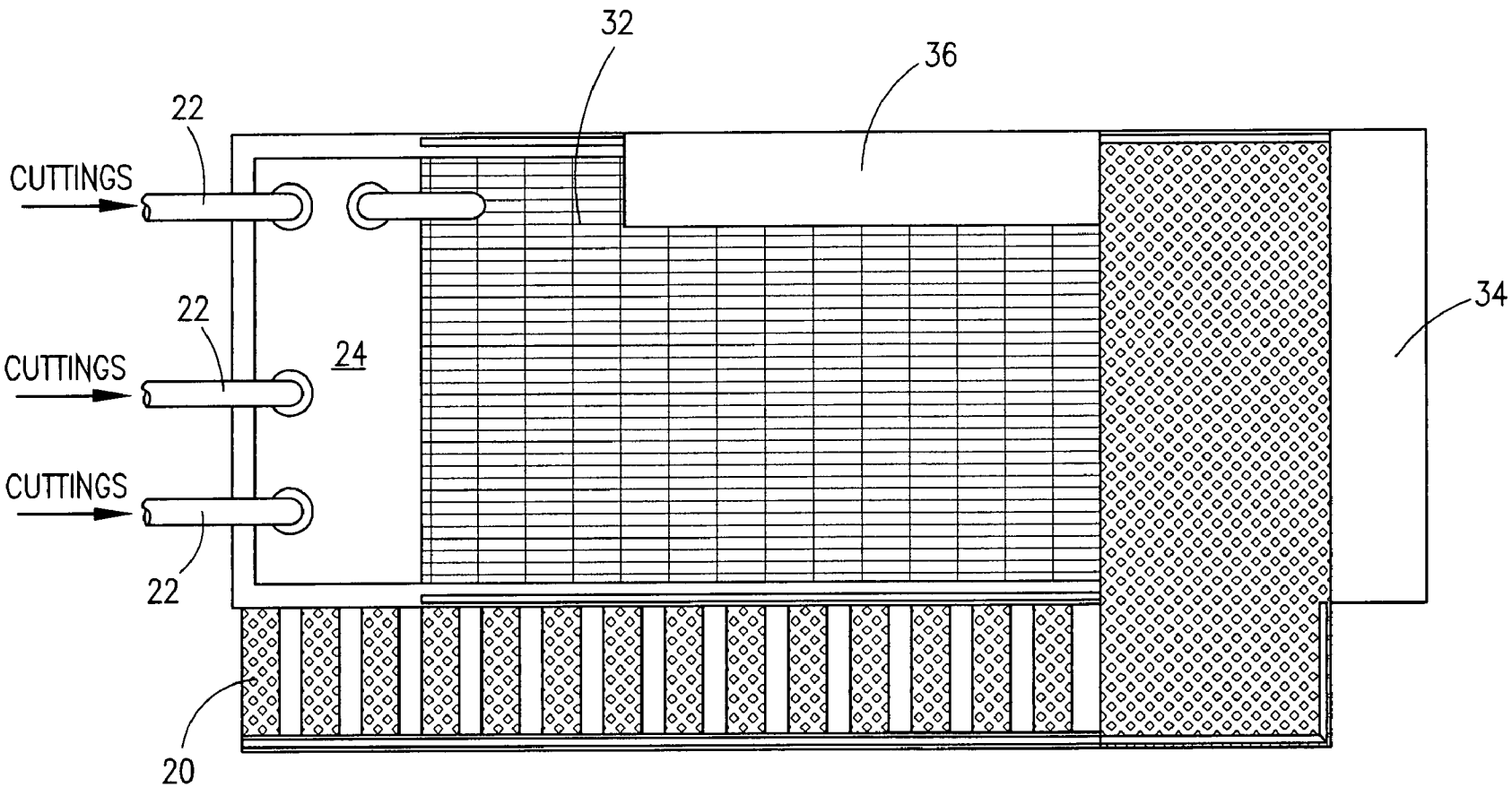
FIG. 2 is a top view of the improved cuttings injection system.

As shown in FIG. 1, the improved injection system 10 includes a open top receiving tank 12 that may be supplied on a skid 14 or provided by the drill site thus reducing the need for additional special equipment on site. In any which case the vacuum units and injections pump units 16 and 19 respectively may be mounted on separate or combined equipment skids as shown or independent of the tank unit 12. In any case a set of steps 20 or ladder for accessing the top of the open receiving tank is generally provided for workers to visually inspect and control the inflow of cuttings through tubing 22 to the receiving tank 12 from shaker screens or other cuttings processing systems via conventional conveying systems or the vacuum hood or plenum 24 and vacuum pump 16 as shown. In this configuration vacuum is maintained on the hood or plenum 24 via the pump or blower 16 suction line 23. Cuttings drop by gravity from an open portion of the hood or plenum 24 submerged into the liquid filled receiving tank 12 where they are continuously agitated and sized via grinding pumps located within the open top receiving tank, forming a slurry of entrained finely ground cuttings and a carrier fluid, before being drawn into the inlet line 26 of an injection pump unit 30 at low pressure for discharge via line 27 into cuttings boxes or high pressure for disposal or injection into the well casing annulus and/or forced into the formation cavities and fractures surrounding a well bore being drilled. Air and hydraulic control panels 34 and electric power panel 36 respectively may be attached to or placed on the upper decking 32 as shown in FIG. 2. Handrails 37 may be added as need to secure the safety of the operating personnel. It is important to note that visual inspection of the cuttings slurry within the liquid filled tank 12 is an important aspect of the cuttings injection process. It is also important for the liquid levels 42 within the receiving tank to be maintained at all times to insure suction on the vacuum hood or plenum 24.

Figure 3:
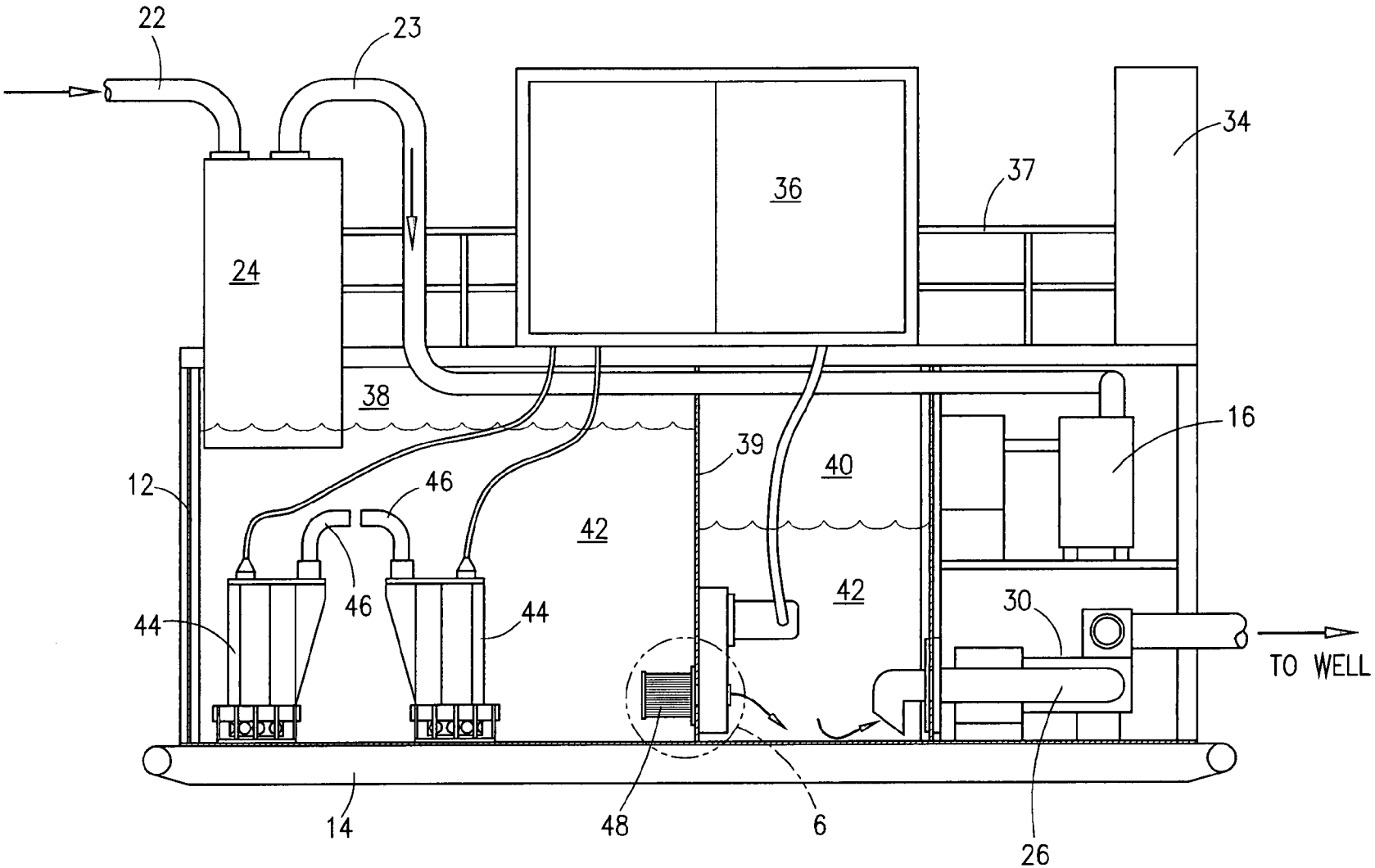
FIG. 3 is a side elevation cross-section view of the improved cuttings system with makeup tank.

Looking now at FIG. 3, we see the receiving or cuttings tank 12 in cross-section is divided into two tanks by partition 39, the slurry-grinding tank 38 and the slurry make-up tank 40. It is essential that slurry liquid 42 in each tank be maintained at a constant level. We also see that submersible grinders 44 are utilized for sizing the cuttings and maintaining the cuttings in constant state of agitation within the grinding tank. The grinders 44 may be placed in opposition to each other in a manner whereby the grinder/pump discharge outlets 46 force cuttings to collide under pressure, thereby further reducing their size. It can also be seen that a filter screen assembly 48 is provided to insure that only properly sized cuttings are allowed to enter the make-up tank 40. In some cases this filter screen assembly may be rotated to prevent cuttings build up on the surface of the filter screen. A more detailed view of this arrangement may be seen in FIG. 6. The cuttings slurry being discharged from the filter screen assembly 48 into the make-up tanks 40 is drawn into the inlet tube 26 of the injection pump 30 and discharged under high pressure to a well bore annulus.

Figure 4:
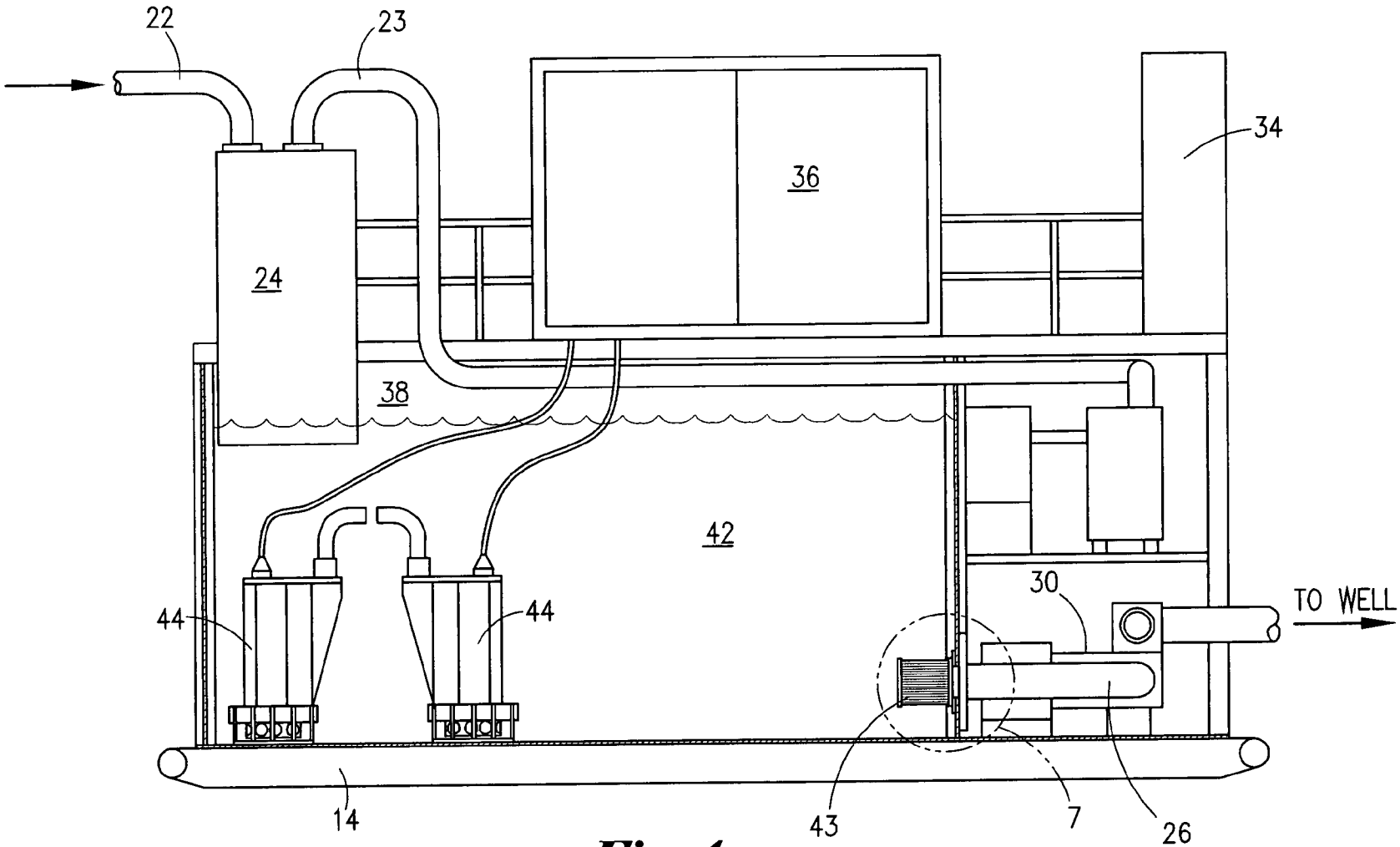
FIG. 4 is a side elevation cross-section view of the improved cuttings system with dual submersible grinders.

In some cases it may be possible to utilize a single grinding tank 42, as shown in FIG. 4, where the filter screen assembly 48 is fixed and attached directly to the inlet 26 of the injection pump 30 for high pressure discharge to the well annulus and its surrounding formation cavities and/or fractures.

Figure 5:
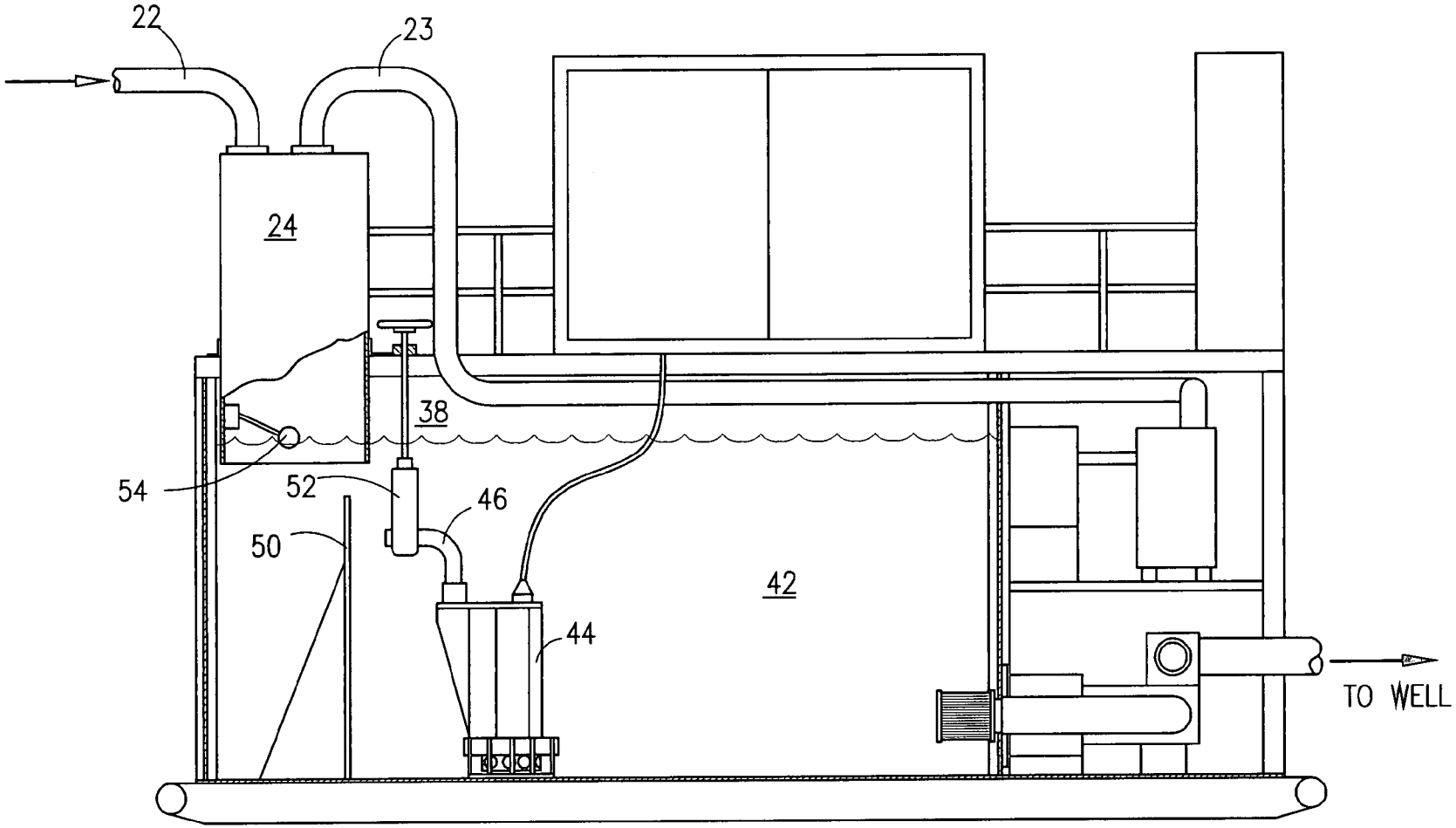
FIG. 5 is a side elevation cross-section view of the improved cuttings system with submersible grinder and impingement control.

Submersible centrifugal grinder pump 44 is fitted with a special impeller having carbide inserts to reduce wear and insure proper grinding of the cuttings. The pump may be located adjacent an impingement plate 50, as shown in FIG. 5, so that the cuttings are directed onto the plate 50 under pressure. This arrangement further reduces clumping and further sizes the cuttings. Submerged centrifugal pumps such as seen in FIG. 5 may be fitted with a variable orifice discharge port such as a valve assembly 52 having an extended actuator rod and handle as further detailed in FIG. 8. However, the adjustable orifice or valve assembly 52 may be attached directly to the discharge outlet 46 of the grinder/pump 44. The valve assembly 52 is usually controlled from the upper deck 32. It is important to understand the need to reduce the discharged orifice size of the pump by up to 50% percent to insure sufficient grinding residence within the grider/pump 44. Float assembly 54 attached to the cuttings hood 24 may automatically control the level of slurry 42 in the slurry tank 38.

Figure 6:
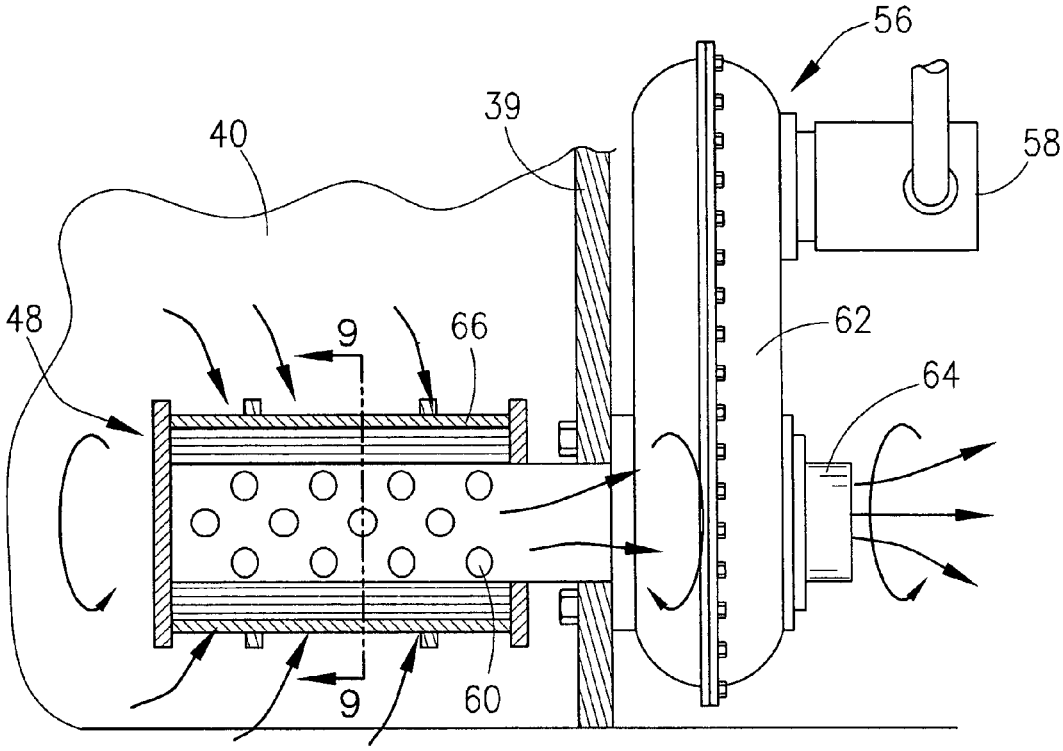
FIG. 6 is a side elevation cross-section view of the rotating screen assembly identified as detail 6 seen in FIG. 3.
Figure 7:
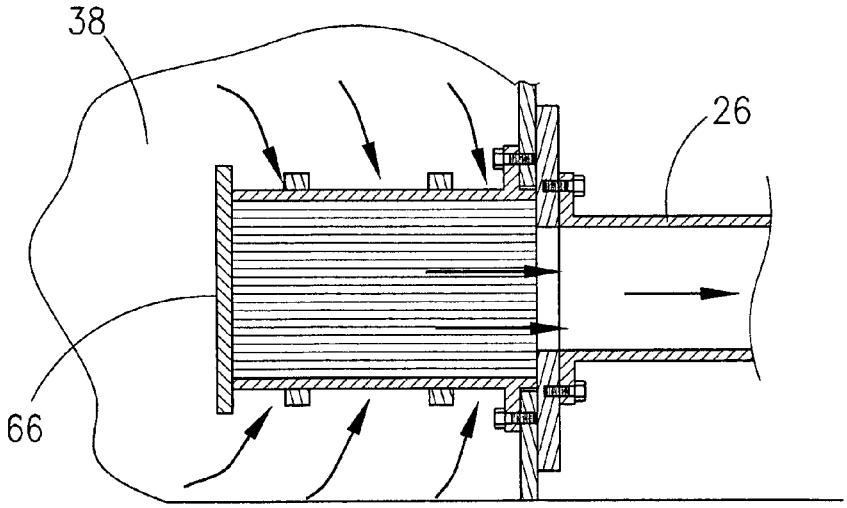
FIG. 7 is a side elevation cross-section view of a non-rotating screen assembly identified as detail 7 seen in FIG. 4

As previously mentioned, the filter screen assembly 48 may be made rotatable, as shown in detail in FIG. 6. In this case a hollow shaft gear reducer assembly 56 is mounted to the make-up tank side of the partition wall 39 and driven by either a pneumatic, hydraulic, or electric gear motor 58. A tubular shaft 64 with a plurality of holes 60 therein is inserted through the hollow shaft portion of the gear reducer 62 and secured therein. The linear screen assembly 48 is secured to the tubular shaft 64 surrounding the holes and in a manner whereby the linear screen allows the passage of the proper size cuttings in the slurry to pass the screen 66 and to enter the holes 60 for discharge into make-up tank. However, the linear screen 66 may be non-rotatably fitted to the wall of the tank 38 and attached directly to the intake tube 26 as shown in FIG. 7.

Figure 8:
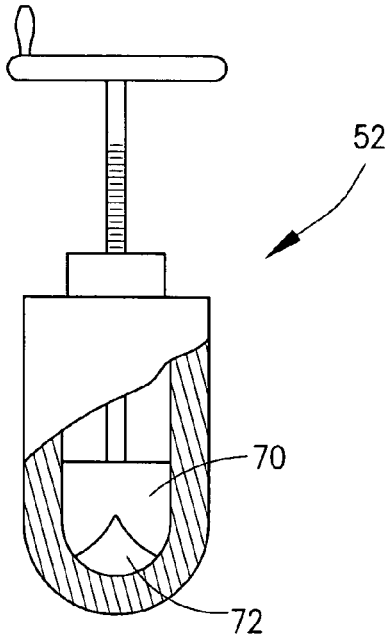
FIG. 8 is a partial cross-section view of the valve assembly seen in FIG. 5.

As further detailed in FIG. 8, the valve assembly 52 previously mentioned shows that the spade portion 70 of the valve assembly 52 has a "V" shaped notched opening 72 which provides an inability to fully close off material flow though the valve. This prevents the possibility of placing the grinding pump 44 in a fully blocked condition, thus producing pump cavitations.

Figure 9:
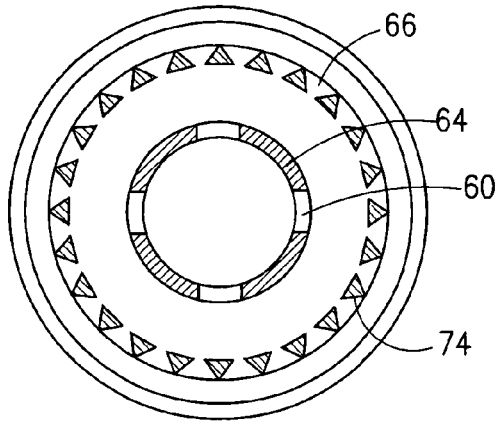
FIG. 9 is a cross-section view of the screen assembly seen in FIG. 6 taken along sight lines 9-9.

As shown in FIG. 9, the filter screen 66 is composed of a series of longitudinal triangular bars 74 held in a spaced-apart configuration, thus allowing only the properly sized cuttings to pass. Such screens are fabricated for a particular use and are widely used in the industry where heavy material loads and pressures are encountered.

Figure 10:
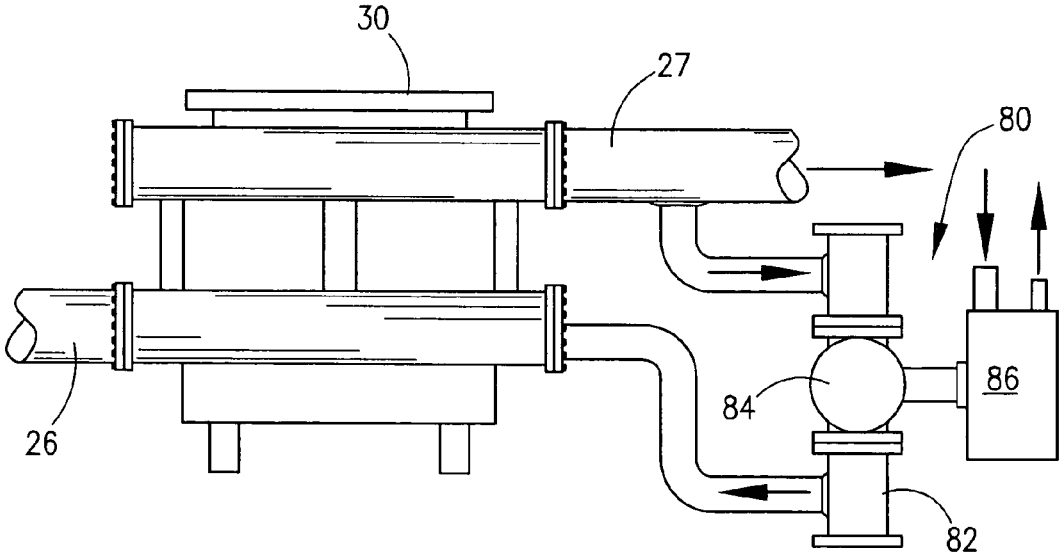
FIG. 10. is an end view of the triplex pump inlet and outlet manifold.

Looking at FIG. 10, a crossover or feedback relief system 80 is provided for releasing the pressure on the slurry being pumped from the grinding tank 38 or the make-up tank 40 for discharge to cuttings holding tanks or directly to a well for injection in the annulus and/or fractures down hole. The crossover relief system 80 may be constructed in a variety of ways but the preferred embodiment is simply a loop or manifold tube 82 connected at one end to the discharge tube 27 and at the opposite end to the pump inlet tube 26 with a ball valve 84 there between. The ball valve 84 may be operated to an open or closed position by a rotary actuator assembly 86, which may be hydraulic or electrically driven as required to increase or decrease pressure on the discharge line 27.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A drill cuttings processing system comprising:

a. an open container having a fluid therein;

b. a plenum located above said container having an open portion submerged within said fluid, a blower having a suction port attached to said plenum creating a vacuum within said plenum;

c. at least one located between a source of drill cuttings and said plenum;

d. at least one submersible grinding pump located within said container; and e. a well injection pump means attached to said container for pumping said cuttings and said fluid from said container into a well.

2. The drill cuttings processing system according to claim 1 wherein said container is divided into two compartments.

3. The drill cuttings processing system according to claim 2 wherein said two compartments comprised a make-up tank and a grinding tank.

4. The drill cuttings processing system according to claim 3 wherein said make-up tank further comprises a filter drive assembly.

5. The drill cuttings processing system according to claim 3 wherein said grinding tank further comprises a rotatable linear filter and a tubular shaft extending through said filter drive assembly and in fluid communication with said make-up tank.

6. The drill cuttings processing system according to claim 5 wherein said rotatable linear filter further comprises:

a. an elongated tubular member having a central bore, a capped end and an open end;

b. a plurality of holes perpendicular to said central bore in the proximity of the capped end;

c. a flange member located intermediate said capped end and said open end; and d. a plurality of triangular bars held spaced apart in a radial configuration connected to said cap and said flange member.

7. The drill cuttings processing system according to claim 6 wherein said rotatable filter further comprises a locking collar for retaining said elongated tubular member to said filter drive assembly.

8. The drill cuttings processing system according to claim 3 wherein said grinding tank comprises a plurality of said submersible grinding pumps, each having a discharge port located in direct opposition to a discharge port of an adjacent pump located in close proximity.

9. The drill cuttings processing system according to claim 3 wherein said grinding tank further comprises an impingement plate located adjacent a discharge from at least one said submersible grinding pump.

10. The drill cuttings processing system according to claim 1 wherein said means for pumping said cuttings and fluid from said container is a triplex pump well cuttings injection pump.

11. The drill cuttings processing system according to claim 1 wherein at least one said submersible grinding pump has a discharge port fitted with a valve incapable of complete closure.

12. The drill cuttings processing system according to claim 1 wherein said means for pumping said cuttings and fluid from said container further comprises a suction line filter having a plurality of triangular bars held spaced apart in a radial configuration connected to an end cap at one end and a flange member at the opposite end.

13. The drill cuttings processing system according to claim 1 wherein said means for pumping said cuttings and fluid from said container further comprises a cuttings cross-port relief system.

14. The drill cuttings processing system according to claim 13 wherein said cuttings cross-port relief system comprises:

a. a feed back loop connecting said inlet and outlet lines;

b. a valve located within said feed back loop; and c. a means for controlling the opening and closing of said valve.

15. A drill cuttings processing system comprising:

a. an open container having a fluid therein;

b. a vacuum hood having an open side submerged within said fluid;

c. at least one tubing and a vacuum pump attached to said vacuum hood, an open end of said tubing in contact with a source of drill cuttings;

d. at least one submersible grinding pump having a discharge port fitted with a valve incapable of complete closure located within said container;

e. an impingement plate located within said container; and f. a triplex pump having an inlet and outlet lines, said inlet extending into said container.

16. The drill cuttings processing system according to claim 15 wherein said container is divided into two compartments.

17. The drill cuttings processing system according to claim 16 wherein said two compartments are comprised of a make-up tank and a grinding tank.

18. The drill cuttings processing system according to claim 17 wherein said make-up tank further comprises a filter drive assembly.

19. The drill cuttings processing system according to claim 17 wherein said grinding tank further comprises a rotatable linear filter and a tubular shaft extending through said filter drive assembly and in fluid communication withsaid make-up tank.

20. A process for transferring, slurring, sizing, and injecting drill cuttings comprising the steps of:

a. vacuuming drill cuttings from a cuttings source into an inverted hood having an open side submerged in a fluid-filled open container;

b. depositing said drill cuttings by gravity from said hood into said fluid-filled open container;

c. agitating and sizing said cuttings with submersible grinding pumps, thus producing a slurry; and d. pumping said slurry and selectively-sized cuttings from said container for disposal.

21. The process for transferring, slurring, sizing and injecting drill cuttings according to claim 20 further comprising the step of controlling pressure exerted on said cuttings during said pumping by cross port relief.

* * * * *

UNITED STATES PATENT AND TRADEMARK OFFICE

CERTIFICATE OF CORRECTION

PATENT NO. : 7,575,072 B2
APPLICATION NO. : 11/286476
DATED : August 18, 2009
INVENTOR(S) : Jeffrey A. Reddoch, Sr.

It is certified that error appears in the above-identified patent and that said Letters Patent is hereby corrected as shown below:

Col. 5, line 11 the word --tubing-- is inserted following the words "at least one".

Signed and Sealed this

Sixth Day of October, 2009

David J. Kappos

David J. Kappos
*Director of the United States Patent and Trademark Office*